United States Patent [19]

Vogel

[11] 4,081,295

[45] Mar. 28, 1978

[54] FABRICATING PROCESS FOR HIGH STRENGTH, LOW DUCTILITY NICKEL BASE ALLOYS

[75] Inventor: Eric S. Vogel, Manchester, Conn.

[73] Assignee: United Technologies Corporation, Hartford, Conn.

[21] Appl. No.: 802,926

[22] Filed: Jun. 2, 1977

[51] Int. Cl.[2] ..... B22F 5/04

[52] U.S. Cl. ..... 148/11.5 N; 148/11.5 P

[58] Field of Search ..... 148/11.5 N, 11.5 P, 148/11.5 F; 75/950

[56] References Cited

U.S. PATENT DOCUMENTS

| | | | |
|---|---|---|---|
| 3,639,179 | 2/1972 | Reichman et al. | 148/11.5 P |
| 3,655,458 | 4/1972 | Reichman | 148/11.5 P |
| 3,698,962 | 10/1972 | Kasak et al. | 148/11.5 P |
| 3,702,791 | 11/1972 | Freche et al. | 148/11.5 P |
| 3,850,702 | 11/1974 | Buchanan | 148/11.5 N |

*Primary Examiner*—W. Stallard

*Attorney, Agent, or Firm*—Edward J. Timmer

[57] ABSTRACT

The present invention provides an improved process for fabricating shaped articles from high strength, low ductility nickel base alloys, especially modified IN100. According to the process, the alloy in prealloyed powdered form is hot isostatically pressed to provide a homogeneous, solid billet. The pressed, low ductility billet is then isothermally forged to shape in hot dies in a single forging pass which includes an initial slow strain rate stage to effect a minor reduction in thickness sufficient to refine the alloy grain structure and place the billet in a temporary condition of low strength and high ductility followed by a high strain rate stage for effecting a major reduction in thickness to the final desired shape while the billet is in said temporary condition. In the initial slow strain rate stage, the strain rate is selected in relation to the isothermal forging temperature such that the rate is sufficiently slow to prevent cracking of the alloy billet during the initial minor reduction. In the high strain rate stage, the strain rate employed is generally significantly higher than that used in the initial stage to assure attainment of desirable mechanical properties in the heat treated article.

10 Claims, No Drawings

FABRICATING PROCESS FOR HIGH STRENGTH, LOW DUCTILITY NICKEL BASE ALLOYS

BACKGROUND OF THE INVENTION

1. Field of the Invention

The present invention relates to high strength, low ductility nickel base alloys and, more particularly, to processes for fabricating these alloys into useful article shapes.

2. Description of the Prior Art

In the gas turbine engine industry, to which the invention has particular application, the engine design criteria require the use of alloys having good high temperature strength and oxidation resistance. In response to the need, a number of nickel base alloys have been developed and used. Unfortunately, however, while the high strength demands have been satisfied, they have generally been achieved only at the expense of alloy fabricability, and in the manufacture of jet engines comprising thousands of individual parts of intricate shape formed to close tolerance, fabricability of the alloy is a major factor in determining the extent of its utility.

The Moore and Athey patent, U.S. Pat. No. 3,519,503, of common assignee herewith represents a significant advance in the art of fabricating high strength, low ductility alloys commonly used in gas turbine engines, especially nickel and cobalt base alloys. According to the process described therein, a high strength, low ductility alloy is extruded or otherwise compressively worked at an elevated temperature below the recrystallization temperature to refine the grain structure and place the alloy in a temporary condition of low strength and high ductility, a so-called superplastic condition. Thereafter, the alloy in the temporary superplastic condition is isothermally forged to desired shape in hot dies at a temperature below the recrystallization temperature while substantial grain growth is inhibited. The shaped alloy is finally returned to its original high strength, low ductility condition by conventional heat treatment. Other patents relating to this fabricating process are U.S. Pat. Nos. 3,698,219 and 3,987,658, both of common assignee herewith.

In fabricating certain engine components, specifically engine discs made of IN100, by the patented process, it has been found desirable to modify the alloy composition somewhat so that an optimum wrought component is produced. The Cox et al patent, U.S. Pat. No. 3,843,421, of common assignee with the present invention describes such a modified IN100 alloy composition especially tailored for use in the patented fabricating process.

SUMMARY OF THE INVENTION

The present invention provides an improved process for fabricating high strength, low ductility nickel base alloys into articles of useful shape. It is especially advantageous in fabricating the modified IN100 alloy described in the patent cited above.

Briefly, the present invention contemplates hot isostatically pressing the nickel base alloy in prealloyed powdered form to provide a substantially homogeneous, solid billet, the billet exhibiting high strength, and low ductility; that is, being nonsuperplastic. The pressed, low ductility billet is then isothermally forged to shape in hot dies at a temperature below but within 350° F of the normal recrystallization temperature of the alloy, the forging operation being conducted in a single forging pass which includes: a) an initial slow strain rate stage in which the billet is initially forged at a slow strain rate to produce a reduction in thickness of at least about 10% to effect in situ recrystallization and refinement of the grain structure and to place the billet in a temporary condition of low strength and high ductility and, b) a high strain rate stage following the initial reduction in which later stage continued forging of the billet in the temporary superplastic condition is conducted at a higher strain rate to effect a major reduction in thickness to the final desired shape. In the initial stage of forging, it is important that the strain rate be selected in relation to the forging temperature such that the rate is sufficiently slow to prevent cracking of the pressed billet during development of the superplastic condition. In contrast, in the later stage of forging, the strain rate is generally much higher to assure attainment of desirable mechanical properties in the heat treated article.

In a preferred embodiment of the invention for fabricating the modified IN100 alloy, the low ductility billet resulting from hot isostatic pressing is initially forged in the hot dies at a slow strain rate of 0.1 in./in./min. or below to produce a reduction in thickness from about 15 to about 35% to recrystallize and refine the billet grain structure and impart temporary superplastic characteristics thereto and then is further forged to the final desired shape at a higher strain rate, typically above 0.1 in./in./min., preferably from about 0.3 in./in./min. to about 0.7 in./in./min., a reduction in thickness of 50% or more usually being effected in the high strain rate stage.

Other advantages and objects of the present invention will appear more fully from the following detailed description of the preferred embodiment.

DESCRIPTION OF THE PREFERRED EMBODIMENT

The modified IN100 alloy is of major importance in fabricating gas turbine engine components, specifically engine discs, as a result of its unique combination of mechanical and physical properties and improved notched strength. Consequently, it has been the subject of numerous experimental investigations with the purpose being to provide an optimum fabricating process by which shaped articles, such as engine discs, can be made most economically and with the highest possible quality in terms of chemical, structural and mechanical property homogeneity and consistency. The present invention provides such improved fabrication process.

According to the present invention, the fabrication process begins by forming a relatively simple shaped billet from prealloyed powder of modified IN100 alloy by hot isostatically pressing the powder in a suitably shaped container, such as a mild steel can. The alloy billet produced by such hot isostatic pressing provides significant advantages in later processing steps since the billet is substantially homogeneous in chemistry, structure and the like, and is substantially free of porosity. Of course, the hot isostatic pressing parameters used will vary depending upon the particular nickel base alloy being pressed but, for the modified IN100 alloy, the parameters are generally in the following ranges: a temperature from about 1900° to about 2150° F; a pressure from about 10 ksi to about 30 ksi and time from about 15 minutes to about 4 hours. It should be noted that the IN100 billet produced by hot isostatic pressing is not in a temporary superplastic condition but rather continues to exhibit the high strength, low ductility characteristics of the alloy.

The next step in the process of the invention involves isothermally forging the pressed alloy billet to shape in hot dies at a temperature below but within about 350° F of the normal recrystallization temperature of the alloy. As explained hereinbelow, through careful adjustment of the forging parameters such as forging temperature and strain rate, forging of the billet to shape can be conducted in the dot dies in a single uninterrupted forging pass, even though the billet is initially not in a temporary condition of low strength and high ductility. It has been discovered that in order to successfully forge the alloy in such a manner, the forging pass must be conducted in two distinct stages characterized as an initial slow strain rate stage and a subsequent high strain rate stage.

The purpose of the initial slow strain rate stage is to initially reduce the alloy billet a minor but critical amount to cause in situ recrystallization and refinement of the billet grain structure and place the billet in a temporary superplastic condition, that is, a condition of low strength and high ductility. Unexpectedly, it was discovered that reductions in thickness of as little as about 10% (preferably 15 to 35%) under suitable conditions of temperature and strain rate would induce the alloy billet to become temporarily superplastic. However, during this initial reduction, it was also discovered that the relationship between the forging temperature and strain rate was very important. For example, it has been found that for a particular forging temperature, there appears to be a critical narrow strain rate range above which cracking of the alloy billet will occur during the initial reduction but below which cracking is not observed. Although the critical strain rate range varies somewhat with the forging temperature for modified IN100 alloy, strain rates of 0.1 in./in./min. or below have been found to provide the greatest assurance against billet cracking during development of the superplastic condition during the initial reduction in thickness. Rates above 0.1 in./in./min. during initial reduction are more prone to cause cracking, and therefore, are to be avoided.

Once the pressed billet is placed in the temporary superplastic condition, the high strain rate stage of forging is begun in which a major reduction in thickness, typically 50% or more, is effected to form the final desired shape. Since the alloy billet has very high ductility, high strain rates can be utilized to achieve the major reduction. However, it has been found that a certain minimum high strain rate is required in this stage to consistently develop optimum properties, such as yield and tensile strength, in the heat treated article. For example, in further forging the modified IN100 billet after it assumes the superplastic condition, strain rates above 0.1 in./in./min. are deemed necessary to develop desirable yield and tensile strengths. A strain rate from about 0.3 in./in./min. to about 0.75 in./in./min. is preferred to develop optimum heat treated properties. It is thought that the minimum high strain rate required provides a critical level of thermalmechanical work in the alloy and a corresponding optimum grain or dislocation structure or substructure which is susceptible to heat treatment.

Of course, after the final article shape is forged, the alloy can be returned to its normal condition of high strength and hardness by a conventional heat treatment including a solution heat treatment, such as 2050° F for modified IN100, and stabilization and precipitation heat treatments.

The following example is illustrative of a fabrication process in accordance with the present invention.

EXAMPLE 1

Prealloyed modified IN100 powder was hot isostatically pressed in pressurized argon at a temperature of 2050° F and a pressure of 15 ksi for 2 hours to provide a homogeneous, solid billet for forging. The billet was not in a superplastic condition after hot pressing. The pressed billet was then heated to 2050° F and placed in hot forging dies. The initial stage of forging was conducted at a strain rate of .1 in./in./min. to produce a reduction in thickness of 25% which reduction resulted in situ recrystallization and refinement of the billet grain structure and placed the billet in a temporary condition of low strength and high ductility. Upon reaching 25% reduction in thickness, the strain rate was increased to .5 in./in./min. and the final shape produced by a further 50% reduction in thickness. After forging, the IN100 shape was conventionally heat treated and tensile and creep tested at 1300° F. The test results indicated that the IN100 shape produced by the process of the invention exceeded the minimum properties required for a gas turbine engine disc.

Although the specific strain rates and reductions set forth hereinabove have been quantified with respect to the modified IN100 alloy, it is believed that the general limits will be workable with other high strength, low ductility nickel base alloys as well, for example, those discussed in the Moore and Athey patent, U.S. Pat. No. 3,519,503. For example, it is envisioned that at least a 10% reduction in thickness of most high strength, low ductility nickel base alloys in the initial forging stage will be sufficient to place them in the temporary superplastic condition. Likewise, initial slow strain rates below 0.1 in./in./min. and subsequent high strain rates above 0.1 in./in./min. most probably will also be workable with the other nickel base alloys.

Although the invention has been shown and described with respect to illustrative embodiments thereof, it should be understood by those skilled in the art that the foregoing and various other changes may be made without departing from the scope of the invention.

Having thus described typical embodiments of my invention, that which I claim as new and desire to secure by Letters Patent of the United States is:

1. A method for fabricating shaped articles from high strength, low ductility nickel base alloys, comprising:
   (a) hot isostatically pressing the alloy in prealloyed powdered form to provide a substantially homogeneous, solid billet, said pressed billet exhibiting high strength and low ductility;
   (b) isothermally forging the pressed alloy billet in hot dies at a temperature below but within 350° F of the normal recrystallization temperature of the alloy in a single forging pass which includes:
      (1) an initial slow strain rate stage including initially forging the pressed alloy billet at a slow strain rate to produce at least a 10% reduction in thickness and effect in situ recrystallization and refinement of the billet grain structure for placing the billet in a temporary condition of low strength and high ductility, the strain rate being selected in relation to the forging temperature such that the rate is sufficiently slow to prevent cracking of the alloy billet during said initial reduction; and (2) a high strain rate stage following the initial reduction including continued forging of the billet at an increased strain rate to produce a major reduction in thickness to the final desired shape while the billet is in said temporary condition, the strain rate employed being higher than that used in the initial reduction stage to assure development of desirable mechanical properties in the heat treated article.

2. The method of claim 1 wherein the initial slow strain rate is up to about 0.1 in./in./min.

3. The method of claim 1 wherein the high strain rate is above 0.1 in./in./min.

4. The method of claim 1 wherein the nickel base alloy being fabricated is modified IN100 alloy.

5. The method of claim 4 wherein initial forging at a slow strain rate produces a reduction in thickness from about 15% to about 35%.

6. The method of claim 4 wherein the initial slow strain rate is up to 0.1 in./in./min. and the high strain rate is from about 0.3 in./in./min. to about 0.75 in./in./-min.

7. The method of claim 4 wherein the alloy is fabricated into the shape of a gas turbine engine disc.

8. A method for fabricating shaped articles from modified IN100 alloy comprising:

(a) hot isostatically pressing the allow in prealloyed powdered form to provide a substantially homogeneous, solid billet, said pressed billet exhibiting high strength and low ductility;

(b) isothermally forging the pressed alloy billet in hot dies at a temperature of about 1800° to 2100° F in a single forging pass which includes:

(1) an initial slow strain rate stage including initially forging the alloy billet at a strain rate up to 0.1 in./in./min. to produce at least a 10% reduction in thickness and effect in situ recrystallization and refinement of the billet grain structure for placing the billet in a temporary condition of low strength and high ductility; and (2) a high strain rate stage following the initial reduction including continued forging of the billet at an increased strain rate from about 0.3 in./in./min. to about 0.75 in./in./min. to produce a major reduction in thickness to the final desired shape while the billet is in said temporary condition.

9. The method of claim 8 wherein the initial reduction in thickness is from about 15% to about 35%.

10. The method of claim 8 wherein the alloy is fabricated into the shape of a gas turbine engine disc.

* * * * *